US006523792B2

(12) United States Patent
Fishler

(10) Patent No.: US 6,523,792 B2
(45) Date of Patent: Feb. 25, 2003

(54) PLUSH BOTTLE HOLDER

(75) Inventor: Brenda Clark Fishler, Santa Clarita, CA (US)

(73) Assignee: Baby Dayz, Inc., Santa Clarita, CA (US)

( * ) Notice: Subject to any disclaimer, the term of this patent is extended or adjusted under 35 U.S.C. 154(b) by 0 days.

(21) Appl. No.: 10/053,092

(22) Filed: Jan. 23, 2002

(65) Prior Publication Data

US 2002/0104933 A1 Aug. 8, 2002

Related U.S. Application Data

(60) Provisional application No. 60/265,678, filed on Feb. 2, 2001.

(51) Int. Cl.[7] ..... A47D 15/00; A61J 9/06

(52) U.S. Cl. ..... 248/102; 248/105

(58) Field of Search ..... 248/102, 103, 248/105; D24/198, 199

(56) References Cited

U.S. PATENT DOCUMENTS

| | | | | | |
|---|---|---|---|---|---|
| 530,435 | A | * | 12/1894 | Lowerre | 248/102 |
| D145,611 | S | * | 9/1946 | Butterfield | D83/8 |
| 2,409,820 | A | * | 10/1946 | Zimmern | 215/12 |
| 4,277,910 | A | * | 7/1981 | Kramer | 446/390 |
| D287,636 | S | * | 1/1987 | Callju | D24/47 |
| 4,809,938 | A | * | 3/1989 | Skinner | 248/102 |
| D305,346 | S | * | 1/1990 | Roberts | D21/162 |
| D314,432 | S | * | 2/1991 | Shaw | D24/48 |
| 5,072,843 | A | * | 12/1991 | James | 215/100 |
| D327,128 | S | * | 6/1992 | Nightingale | D24/199 |
| 5,217,192 | A | * | 6/1993 | Oktayuren | 248/102 |
| 5,419,447 | A | * | 5/1995 | Lim | 215/11.1 |
| D402,761 | S | * | 12/1998 | Jones | D24/199 |
| 5,871,184 | A | * | 2/1999 | Kaopio | 248/102 |
| 5,979,843 | A | * | 11/1999 | Beck | 248/102 |
| 6,003,821 | A | * | 12/1999 | Fabian et al. | 248/104 |
| 6,082,681 | A | * | 7/2000 | Rand | 248/102 |

OTHER PUBLICATIONS

The Milk Bottle Bear, http://www.bababear, 1999.*

* cited by examiner

*Primary Examiner*—Anita King
*Assistant Examiner*—Amy J. Sterling
(74) *Attorney, Agent, or Firm*—Leydig, Voit & Mayer, Ltd.

(57) ABSTRACT

A holder (1)for a generally cylindrical bottle (3), such as a 8 oz. baby bottle, water bottle or sports bottle, having two openings, one that can be secured closed (8) with hook and eye fastening tape (9 and 10) while the other remains open (2) allowing for the neck of the bottle to protrude thereby providing access for consumption of beverage in said bottle. The holder (1) is comprised of insulating material and will keep the beverage in said bottle (3) at a desired temperature. When the bottle (3) is inserted into the holder (1) the neck of the bottle that protrudes through the top aperture (2) completes the animal/creature's face by representing it's nose or muzzle.

10 Claims, 5 Drawing Sheets

PLUSH BOTTLE HOLDER

This application claims the benefit of provisional application No. 60/265,678 filed Feb. 2, 2001.

FEDERALLY SPONSORED RESEARCH

Not Applicable

SEQUENCE LISTING OF PROGRAM

Not Applicable

BACKGROUND OF THE INVENTION

1. Field of the Invention

The present invention relates to bottle covers and more specifically to an improved holder for a baby bottle or other one pint bottles that provides insulation for a variety of bottle shapes as well as amusement for the user.

2. Discussion of Prior Art

Infant care givers commonly attempt to simplify their care giving by using products that are either time-saving or amusing to the infant. Most babies have a preference for the temperature of their bottle. Care givers find maintaining the fluid temperature time consuming. Traditional bottle insulators maintain the fluid's temperature until the infant requires nourishment, however once the bottle is taken out of the holder the temperature quickly adjusts to the the infant with toys such as stuffed animals.

Many bottle covers have been provided in prior art. Some examples are Gammelgaard U.S. Pat. No. 5,624,090 where the bottle is held by a stuffed animal for hands-free feeding of the infant but is made up of two separate pieces. The bottle holder by Oktayuren U.S. Pat. No. 5,217,192 is a stuffed animal holding a bottle but does not provide any insulation benefits. These are all illustrative of such prior art. These inventions are suitable for their intended purpose but they do not meet the needs that the plush bottle holder does, heretofore described.

Most of the previous designs for bottle holders are either purely functional or purely decorative. They lack a simple combination of the two qualities.

U.S. Pat. No. 5,871,184 "Holder for a baby bottle" issued to Le Vaughn Kaopio represents one solution. It is described as a holder for a baby bottle having a cap with a nipple extending therethrough. The holder comprises an insulating jacket having a central aperture extending vertically therein. The insulation jacket is a stuffed animal and will protect the baby bottle from breakage while keeping a beverage within the baby bottle at a desired temperature. This holder has several disadvantages:

a) the inner aperture does not accommodate bottles of various circumferences.

b) the holder does not allow for the consumption of fluid in the bottle while the bottle is still in the holder.

c) the unit is not collapsible due to hard inner aperture.

d) the holder is large and therefore difficult for a young child to hold by themselves.

OBJECTS AND ADVANTAGES

This object and advantages of the simple bottle holder described in my above patent are:

a) to provide a bottle holder that is simple and easy to use;

b) to provide a bottle holder in the form of and animal or creature; material;

e) to provide a bottle holder that offers an animated quality which is entertaining to a child;

f) to provide a bottle holder that has a inner sheath that absorbs condensation from a cold bottle;

g) to provide a bottle holder that can accommodate bottles of various sizes;

h) to provide a bottle holder that is light and has appendages that allow for small hands to grasp and hold the unit for use;

i) to provide a bottle holder that can be compressed for storage in a pocket or bag; and j) to provide a bottle holder that is entirely machine washable.

SUMMARY

In accordance with the present invention a simple holder for a bottle comprises a plush material sheath in the form of a creature or animal.

BRIEF DESCRIPTION OF DRAWINGS

Various other objects, features and attendant advantages of the present invention will become better understood when considered in conjunction with the accompanying drawings, in which like reference characters designate the same parts throughout the several views, and wherein.

Drawing Figures

Figure 1:
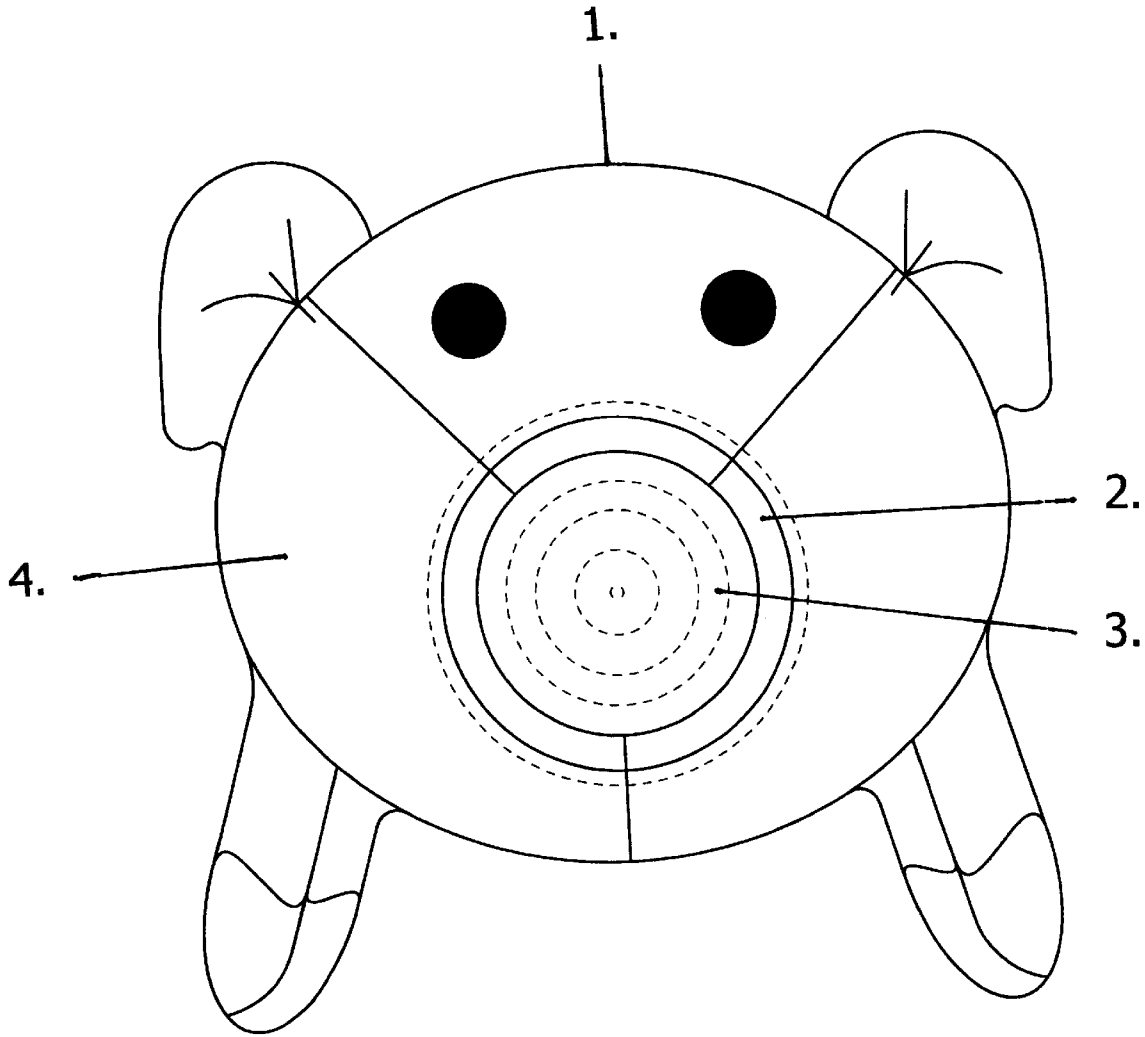
FIG. 1 is a top elevation of the bottle holder.
Figure 2:
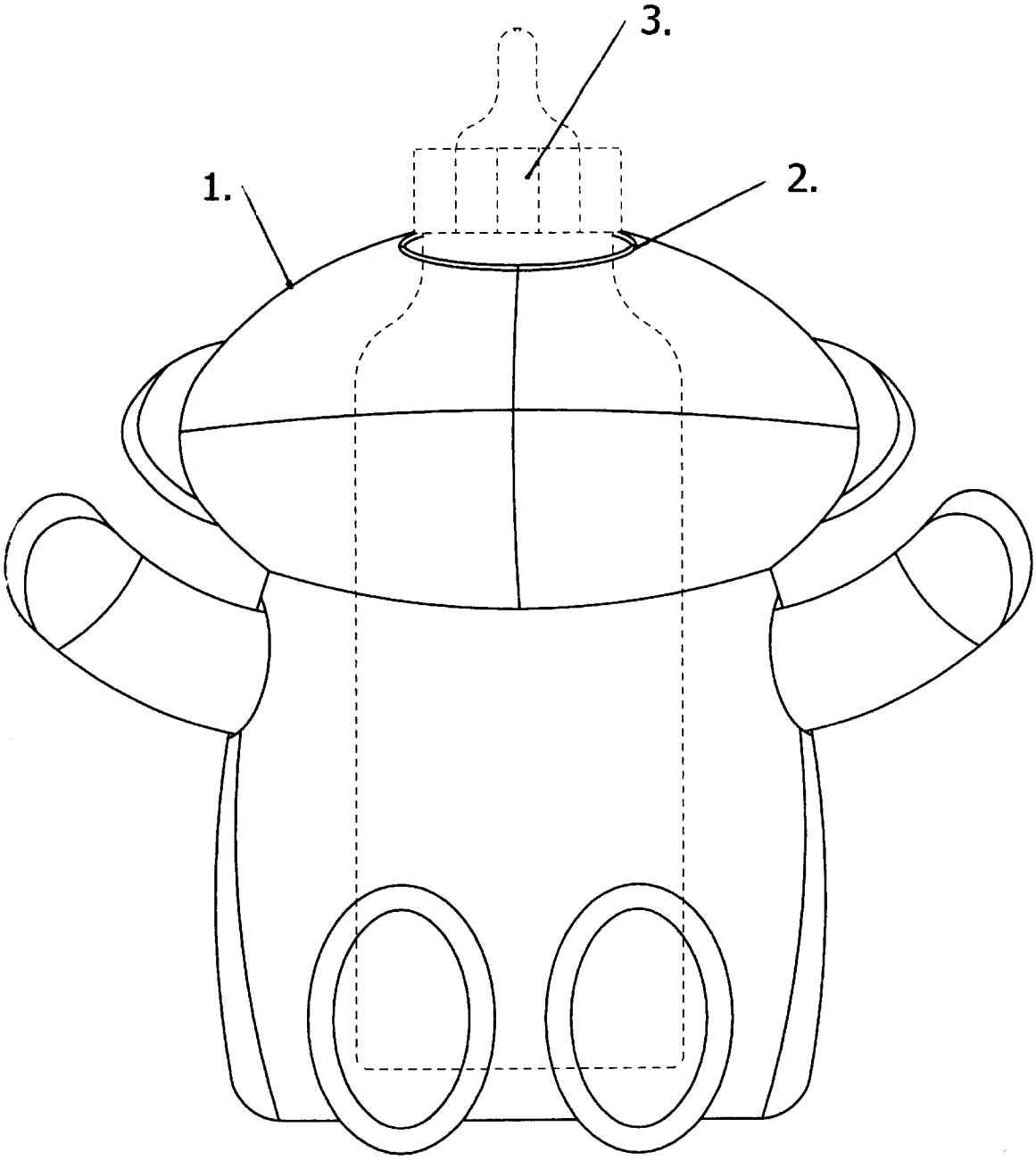
FIG. 2 is a front elevation view thereof.
Figure 3:
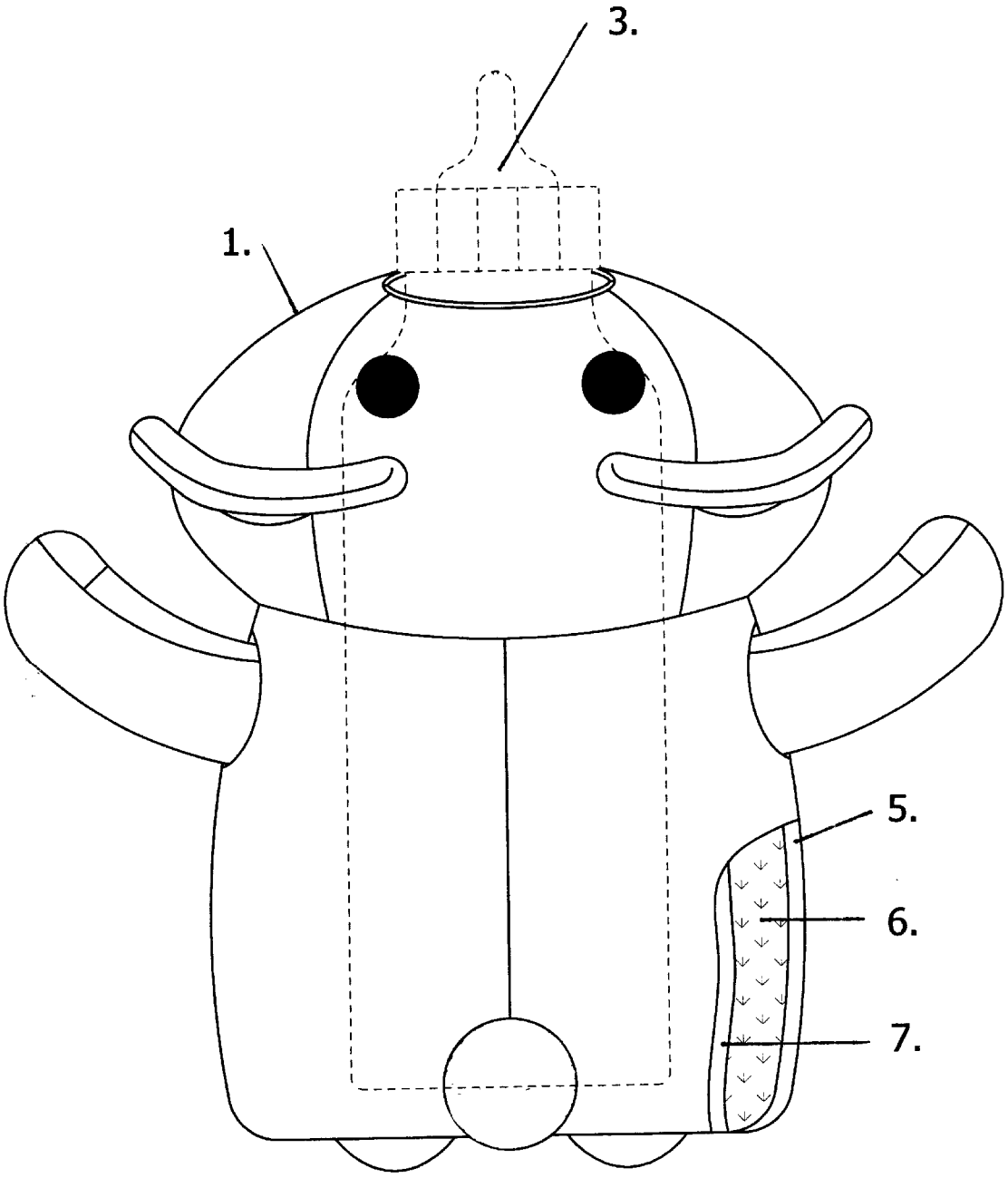
FIG. 3 is a rear elevation view thereof.
Figure 4:
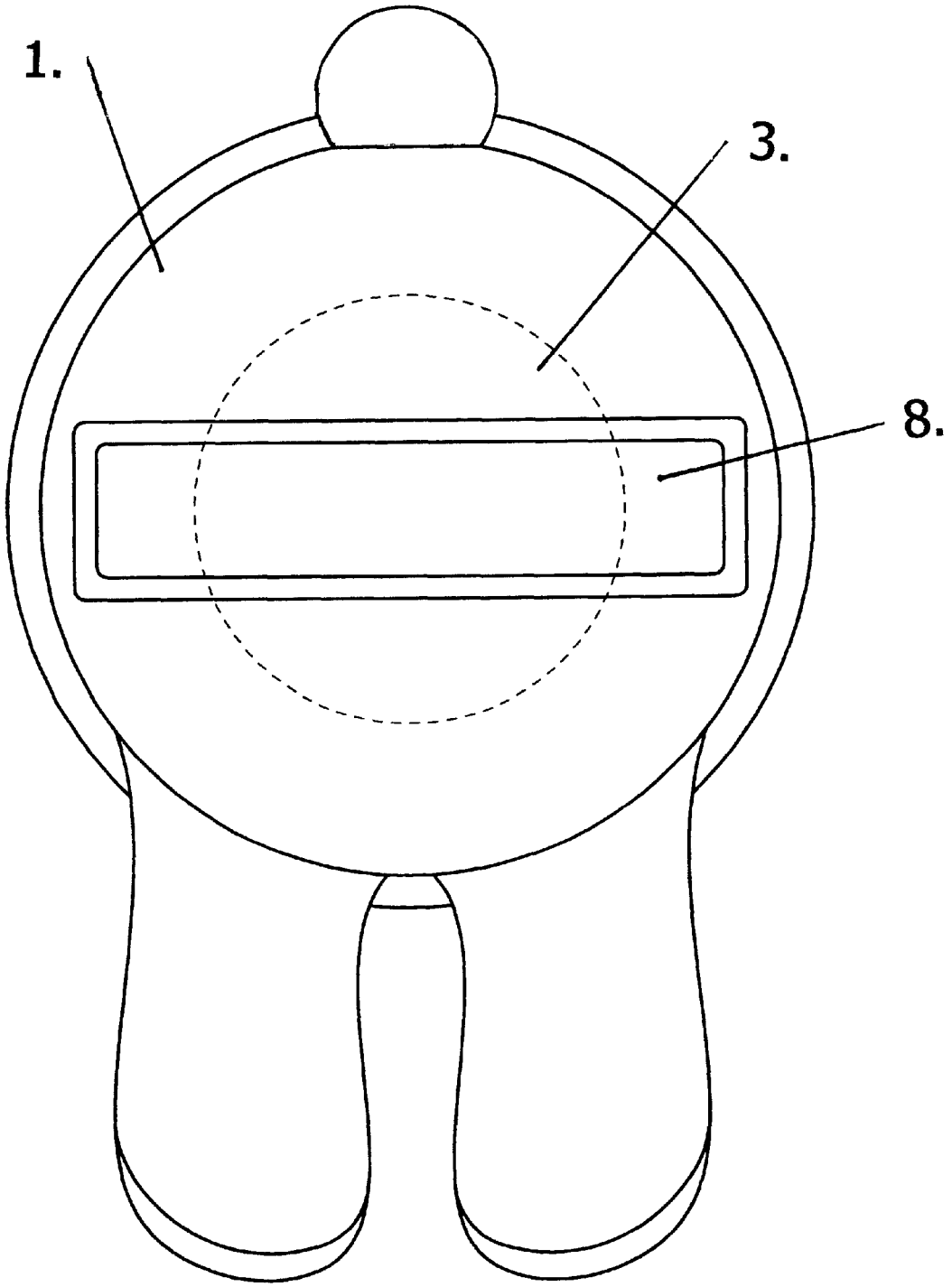
FIG. 4 is a bottom elevation view closed thereof.

The broken line showing the bottle in FIGS. 1–4 is for illustration purposes only and forms no part of the claimed utility.

1 holder for 3
2 holder's top opening or aperture
3 bottle
4 Plush animal/creature insulation jacket of 1
5 Outer fleece/plush material of 1
6 Polyfill stuffing of 1
7 Inner sheath fleece/plush material of 1
8 Bottom opening: closed position of 1
9 Hook and loop fastening tape:hook side of 8
10 Hook and loop fastening tape: loop side of 8
11 Bottom opening: open position 1

DETAILED DESCRIPTION

Figure 5:
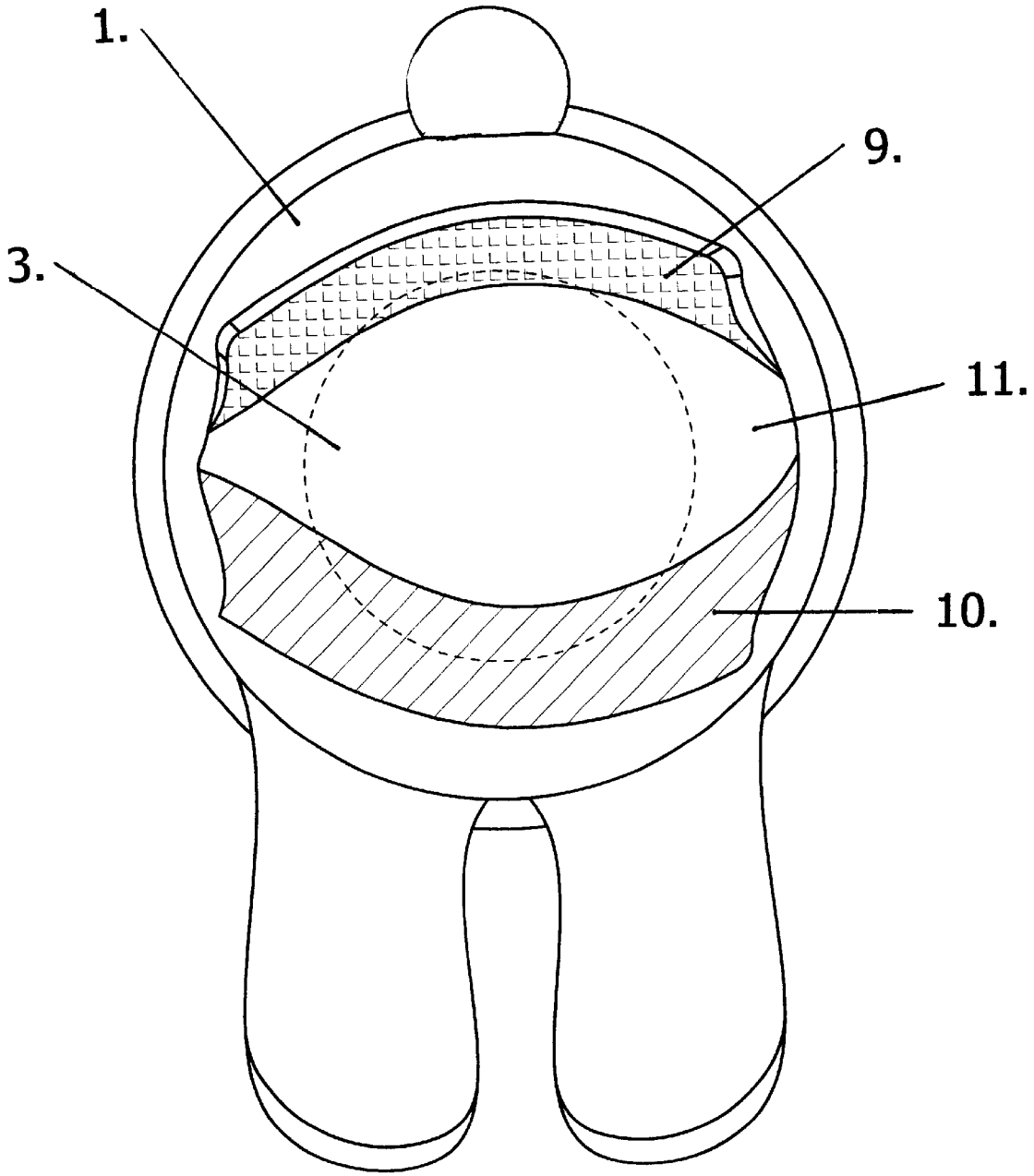
FIG. 5 is a bottom elevation view open thereof.

Description-FIGS. 1–5 Preferred Embodiment

The The holder comprises of an insulation jacket 4 having a soft inner sheath 7 extending vertically within. The holder 1 is for a bottle 3 having a top opening or aperture 2 with the top opening of the bottle 3 extending therethrough. The bottle is urged through the bottom opening 11 and then the bottom opening 11 is secured closed using hook and eye fastening tape 9 and 10. The insulation jacket 4 will keep the beverage 12 in the bottle 3 at a desired temperature.

The insulation jacket 4 is comprised of three layers. The three layers consist of an outer fleece/plush material 5, polyfill stuffing 6 and an inner sheath of plush material 7. These three layers provide insulation for the bottle 3. The washable holder 1 absorbs condensation with it's inner sheath 7 from the outside of cold bottles 3.

FIGS. 1–5 Alternative Embodiments

There are various possibilities with regard to the materials used to create the holder. The outer jacket could be any fabric that is soft and pleasing to the user. The inner sheath could be any flexible material that possesses an absorbent and or insulating quality.

Although the preferred embodiment has been illustrated as being a bear any similar plush creature will do. For example a cow, pig, or bunny require bottom opening could be eliminated and the bottle could be inserted through the top opening.

While there has been illustrated and described a particular embodiment of the invention, it will be appreciated that numerous changes and modifications will occur to those skilled in the art, and it is intended in the appended claims to cover all those changes and modifications which fall within the true spirit and scope of the present invention.

Advantages

From the description above, a number of advantages of my plush bottle holder become evident:

(a) The holder comprised entirely of soft flexible material can expand to allow the insertion of a variety of bottle shapes and sizes.

(b) The holder can be made with basically only two materials: fabric and stuffing.

(c) The holder's shape can be easily altered to represent a plethora of animals thereby providing many choices for the consumer.

Operation FIGS. 1–5

The manner of using the plush bottle holder 1 is simple. One first opens the bottom opening 11 and urges a 4–8 oz. baby bottle, one pint water bottle or sports bottle 3 into and through the inner sheath 7. The neck of the bottle, is then adjusted so that it is fully extended through the top opening 2 such that the bottle forms an element of a face of the animal or creature. (If a baby bottle is used, the collar of the bottle that holds the nipple should be entirely through the top opening.) When the neck and or collar is fully inserted, the beverage can be consumed without the user's mouth coming in contact with the holder. The bottom of the holder 1 is then secured closed using the hook and eye fastening tape 9 and 10. The beverage can then be consumed as needed.

To remove the bottle 3 one simply opens the hook and eye fastening tape 9 and 10 and pulls the bottle 3 out of the holder 1.

CONCLUSION, RAMIFICATION AND SCOPE

Accordingly, the reader will see that the plush bottle holder can simply the condensation that from protecting items that may come in contact with the bottle, such as in a backpack or purse. Since it can accommodate bottles of various sizes it can be used by a variety of aged users as well.

What is claimed is new and desired to be protected by the Letters Patent is set forth in the appended claims:

1. A holder for a bottle that forms an animal or creature when the bottle is inserted in the holder, the holder comprising:

a body having an internal passage extending therethrough from a bottom opening in the body to a top opening in the body, the internal passage being configured to receive a bottle with a portion of the bottle extending beyond the top opening, the body being configured and the top opening being arranged on the body such that the portion of the bottle extending beyond the top opening forms an element of a face of the animal or creature;

a closure element arranged on the body so as to be operable to selectively close the bottom opening, the top opening having at least a first size which is relatively smaller than the bottom opening such that a bottle received in the internal passage is retained so as to allow fluid to be consumed from the bottle; and wherein the body has a stuffed construction which is resiliently compressible such that the body can be compressed for storage and the internal passage is expandable for receiving bottles of varying size.

2. The holder for a bottle as described in claim 1 wherein the body comprises an insulation jacket.

3. The holder for a bottle as described in claim 2 wherein the insulation jacket comprises an outer plush material, a layer of stuffing and inner sheath of plush material, the stuffing layer being disposed between the outer plush material and the inner sheath.

4. The holder for a bottle as described in claim 1 wherein the closure element includes a hook and loop fastener.

5. The holder for a bottle as described in claim 1 wherein the body is constructed of a washable material.

6. A holder for a bottle that forms an animal or creature when the bottle is inserted in the holder, the holder comprising:

a body having an internal passage extending therethrough from a bottom opening in the body to a top opening in the body, the internal passage being configured to receive a bottle with a portion of the bottle extending beyond the top opening, the body being configured and the top opening being arranged on the body such that the portion of the bottle extending beyond the top opening forms an element of a face of the animal or creature;

the bottom opening being configured to allow insertion of a bottle having a diameter within a predetermined diameter range within the internal passage, the top opening being configured to prevent a bottle having a diameter within the predetermined diameter range from passing completely through the top opening;

a closure element arranged on the body so as to be operable to selectively close the bottom opening such that a bottle received in the internal passage is retained so as to allow fluid to be consumed from the bottle; and wherein the body has a stuffed construction which is resiliently compressible such that the body can be compressed for storage and the internal passage is expandable for receiving bottles having a diameter within the predetermined diameter range.

7. The holder for a bottle as described in claim 6 wherein the body comprises an insulation jacket.

8. The holder for a bottle as described in claim 7 wherein the insulation jacket comprises an outer plush material, a layer of stuffing and inner sheath of plush material, the stuffing layer being disposed between the outer plush material and the inner sheath.

9. The holder for a bottle as described in claim 6 wherein the closure element includes a hook and loop fastener.

10. The holder for a bottle as described in claim 6 wherein the body is constructed of a washable material.

* * * * *